US006042462A

United States Patent [19]

Baratti

[11] Patent Number: 6,042,462

[45] Date of Patent: Mar. 28, 2000

[54] FLEXIBLE BACKING FOR ABRASIVE MATERIAL IN SHEETS

[76] Inventor: Paolo Baratti, Via Boscarola, 1, 46026 Quistello (Mantova), Italy

[21] Appl. No.: 09/069,708

[22] Filed: Apr. 29, 1998

[30] Foreign Application Priority Data

Apr. 30, 1997 [IT] Italy ..... MO97U0015

[51] Int. Cl.[7] ..... B24D 7/18

[52] U.S. Cl. ..... 451/533; 51/295; 451/538

[58] Field of Search ..... 451/537–539, 451/533; 51/295, 297, 307

[56] References Cited

U.S. PATENT DOCUMENTS 1,963,357 6/1934 Filley ..... 451/538

3,844,072 10/1974 Haigh et al. ..... 451/537 X 3,849,941 11/1974 Barnes ..... 451/539 X 5,140,785 8/1992 Eleouet ..... 451/533 X

*Primary Examiner*—David A. Scherbel

*Assistant Examiner*—Anthony Ojini

*Attorney, Agent, or Firm*—Fenwick & West LLP

[57] ABSTRACT

A flexible backing for abrasive material in sheets, constituted by a body which is composed of at least three materials which are stably coupled in layers, an intermediate layer being constituted by a steel core, and the outer layers being constituted by laminae made of elastic material which have different moduli of elasticity.

6 Claims, 2 Drawing Sheets

FLEXIBLE BACKING FOR ABRASIVE MATERIAL IN SHEETS

BACKGROUND OF THE INVENTION

The present invention relates to a flexible backing for abrasive material in sheets.

In many fields of work it is necessary to manually smooth variously shaped surfaces.

The most frequent case is constituted by car body shop workers who repair damaged motor vehicles: they are in fact often forced to manually smooth the surfacings performed for said repairs.

Car body shapes are composed of successions of convex and concave surfaces which are often difficult for hand and conventional smoothing tool access.

Said tools generally consist of backings for abrasive material prepared in sheets which are shaped anatomically to facilitate their grip during use.

However, these conventional tools, owing to their structure, do not allow to easily access surfaces which are for example cylindrical, or to adequately treat surfaces with curvatures having a small radius.

This is mainly due to the fact that said tools have a substantially bulky body, provided with protrusions for the grip or, in order to adapt the various types of curvature, are provided with complicated elements for adjusting and fixing the sheets of abrasive material.

Moreover, the fixing of said sheets is also complicated and in view of the rate at which said sheets wear and of the need to gradually modify the "grain" of the abrasive surface, replacing said sheets entails a significant waste of time.

SUMMARY OF THE INVENTION

The technical aim of the present invention is to solve the above problems of the prior art by providing a flexible backing for abrasive material in sheets which allows to treat surfaces having any contour, whose structure is as simplified as possible in order to achieve limited space occupation and costs, and which allows to replace the sheets of abrasive material in a short time and with the maximum operating simplicity.

This aim and other objects are achieved by a flexible backing for abrasive material in sheets, characterized in that it is constituted by a body which is composed of at least three materials which are stably coupled in layers, an intermediate layer being constituted by a steel core, the outer layers being constituted by laminae made of elastic material which have different moduli of elasticity.

BRIEF DESCRIPTION OF THE DRAWINGS

Further characteristics and advantages will become apparent from the description of a preferred embodiment of a flexible backing for abrasive material in sheets, illustrated only by way of non-limitative example in the accompanying drawings, wherein.

DESCRIPTION OF THE PREFERRED EMBODIMENTS

Figure 1:
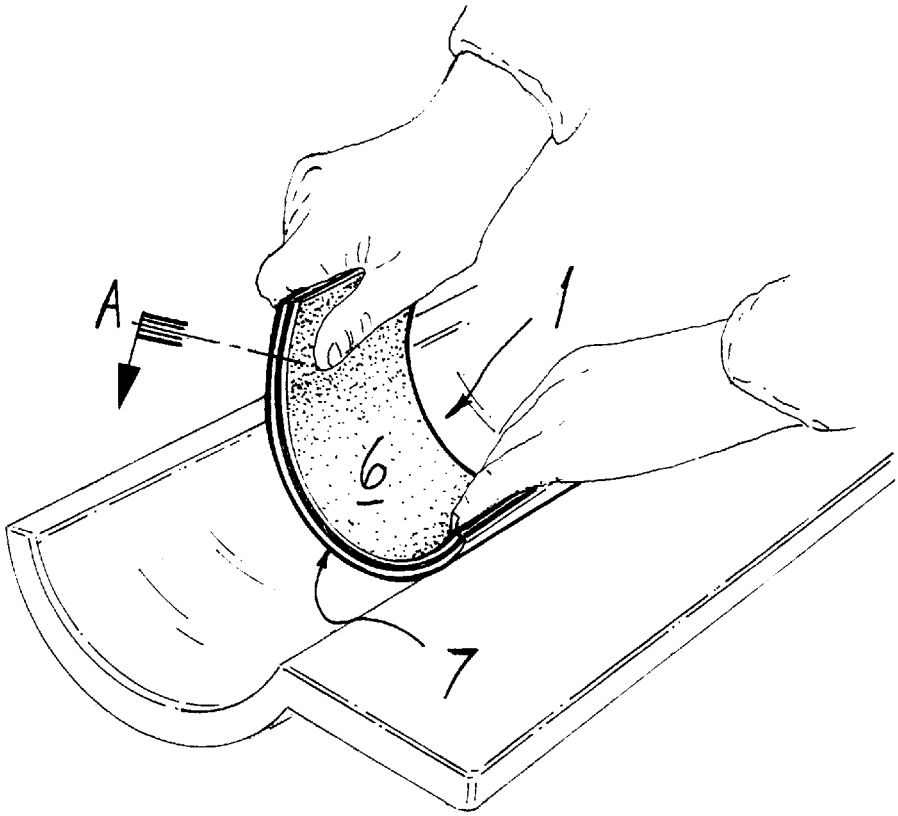
FIG. 1 is a view of the flexible backing for abrasive material in sheets during use on a concave surface.
Figure 2:
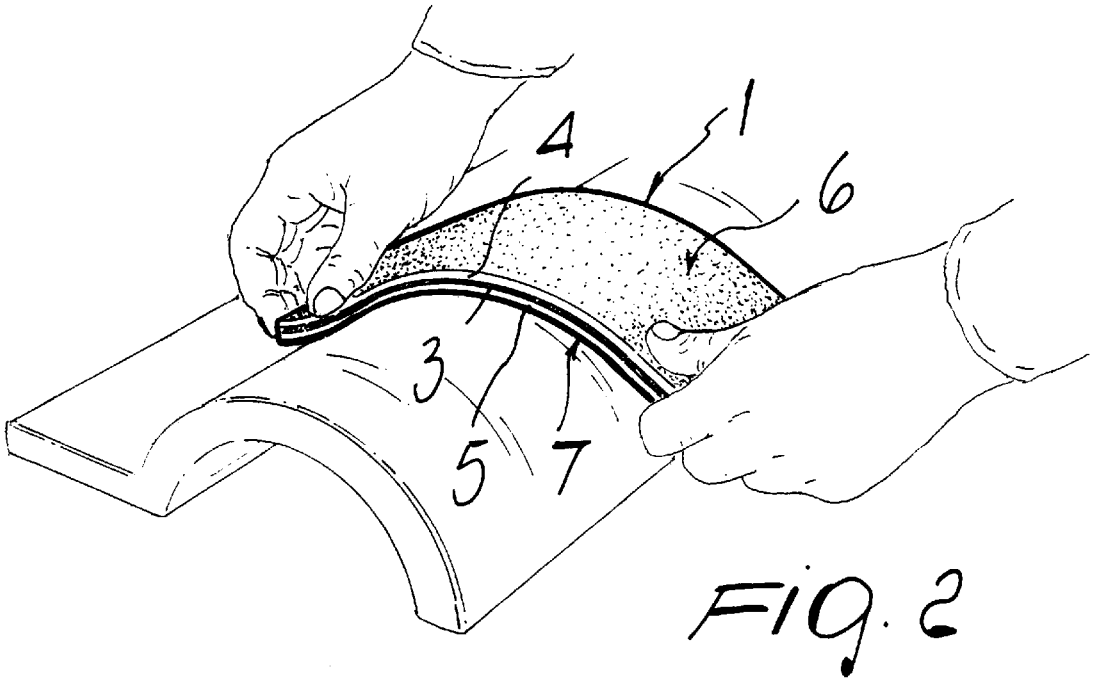
FIG. 2 is a view of the same backing used on a convex surface.
Figure 3:
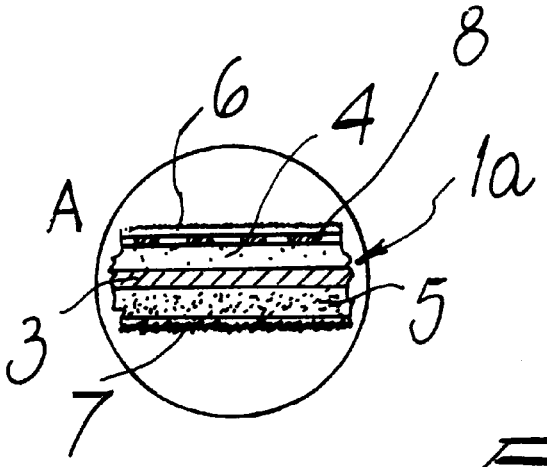
FIG. 3 is a detailed view of a detail of the structure of the elastic backing.
Figure 4:
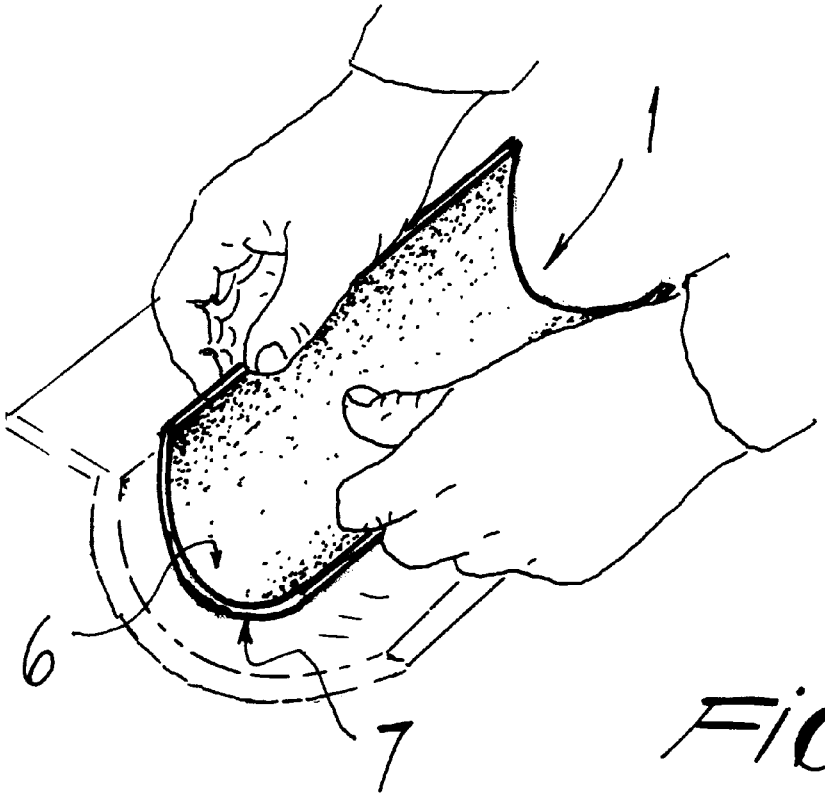
FIG. 4 is a view of the backing, used again on a concave surface and flexed along its longitudinal axis.

With particular reference to the above figures, the reference numeral 1 generally designates an elastic backing for abrasive material prepared in sheets 2.

The backing 1 is constituted by a body 1*a* which is composed of at least three materials which are stably coupled together in layers; an intermediate layer 3 is constituted by a steel core, while the outer layers, respectively 4 and 5, are constituted by laminae made of elastic material which have mutually different moduli of elasticity.

The body 1*a* is substantially plate-shaped, and a sheet 6 of fine-grain abrasive material can be applied to the more flexible layer, conventionally designated by the reference numeral 4, while a sheet 7 of medium- to coarse-grain abrasive material can be applied to the more rigid layer, again conventionally designated by the reference numeral 5; both of said sheets can be fixed to the outward faces of the backing 1 with strips 8 of double-adhesive material, such as for example a separable fastener of the hook and loop type, available under the trademark Velcro® or a conventional tape with two adhesive sides, which constitute the corresponding interposed means.

The use of the invention can be deduced intuitively from the above description: the sheets of abrasive material 6 and 7 are fixed to the backing 1 on the respective outward faces of the layers 4 and 5, taking care to apply the finer-grain sheet (the one designated by the reference numeral 6 in the figures) on the elastically more flexible layer (the one designated by the reference numeral 4 in the figures) in order to be able to provide more accurate finishing.

The backing 1 thus prepared may be thereafter gripped and rubbed on the surface to be smoothed in the same manner used normally with a conventional sheet of sandpaper.

The presence of the steel core that constitutes the central layer 3 allows to automatically recover, after each pass, the flat configuration of the backing 1; moreover, the elastic nature of the layers that compose the body la allows the user to flex it in any manner, for example along the main axes of symmetry or at an angle, in order to reach even the least accessible regions of the surfaces to be treated.

Finally, the two usable sides allow to work with two degrees of finish without having to replace the sheets of abrasive material every time.

To perform replacement required by gradual wear, it is sufficient to tear the used sheet off the strips of double-adhesive material that retain it on the respective layer and apply a new sheet to the strips.

It has thus been found that the described invention achieves the intended aim and objects, i.e., it allows to smooth concave or convex surfaces of any kind, in a practical way and with a structure which is very simple and cheap to provide.

The invention thus conceived is susceptible of modifications and variations, all of which are within the scope of the inventive concept.

All the details may furthermore be replaced with other technically equivalent elements.

In the practical embodiment of the invention, the materials used, the shapes and the dimensions may be any according to the requirements without thereby abandoning the protective scope of the appended claims.

What is claimed is:

1. A flexible backing for sheet abrasive material for manual treatment of surfaces, the flexible backing forming a flat body including at least three materials which are bendable and twistable to adjust to any shaped surface to be treated and having two opposite active faces, said body comprising:

an intermediate resilient core lamina of flat form including first and second opposite sides and having a thickness to facilitate manual bending and twisting thereof and to promote resilient recovery to the flat form;

a first outer flexible layer having a first modulus of elasticity, said first outer layer being stably coupled at a first surface thereof to the first side of said core lamina while providing at a second opposite surface a first one of said active faces;

a second outer flexible layer having a second modulus of elasticity, said second outer layer being stably coupled at a first surface thereof to the opposite second side of the core lamina while providing at a second opposite surface the second one of said active faces; and said first and second moduli of elasticity differ from each other and said first and second outer layers have different flexural rigidity.

2. The flexible backing of claim 1 including connection means on said layers for attaching a sheet of fine-grain abrasive material to the active face of the more flexible layer and for attaching a sheet of medium- to course-grain abrasive material to the active face of the less flexible layer.

3. The flexible backing of claim 2, wherein said connection means include a plurality of strips of double-adhesive material.

4. The flexible backing of claim 3, wherein said double-adhesive material includes a separable fastener of the hook and loop type.

5. The flexible backing of claim 3, wherein said double-adhesive material includes a layer of tape with two adhesive sides.

6. The flexible backing of claim 1, wherein the body is elastically flexible in any direction, and is provided with any of a geometric and a rounded perimeter.

* * * * *